US005552227A

United States Patent [19]

Göldner

[11] Patent Number: 5,552,227

[45] Date of Patent: Sep. 3, 1996

[54] PROCESS OF PRODUCING MULTILAYER COATINGS WITH CATIONIC LAYERS OF PRIMER SURFACE

[75] Inventor: Wolfgang Göldner, Heiligenhaus, Germany

[73] Assignee: Herberts GmbH, Wuppertal, Germany

[21] Appl. No.: 400,297

[22] Filed: Mar. 6, 1995

Related U.S. Application Data

[63] Continuation of Ser. No. 300,578, Sep. 2, 1994, abandoned, which is a continuation of Ser. No. 147,100, Nov. 4, 1993, abandoned, which is a continuation of Ser. No. 959,897, Oct. 13, 1992, abandoned.

[30] Foreign Application Priority Data

Oct. 17, 1991 [DE] Germany ..... 41 34 301.8

[51] Int. Cl.[6] ..... B05D 1/36; B05D 1/38

[52] U.S. Cl. ..... 428/423.1; 427/407.1; 427/409

[58] Field of Search ..... 427/409, 407.1, 427/412.1, 410, 388.4; 428/423.1, 457, 474.4

[56] References Cited

U.S. PATENT DOCUMENTS

| | | | |
|---|---|---|---|
| 4,375,498 | 3/1983 | Le Minez et al. | 427/410 |
| 4,529,632 | 7/1985 | Fujii et al. | 427/409 |
| 4,554,061 | 11/1985 | Ritchie | 427/222 |
| 4,615,779 | 10/1986 | McCollum et al. | 204/181.7 |
| 4,661,223 | 4/1987 | Zedler et al. | 427/388.2 |
| 4,741,932 | 5/1988 | Ichimura et al. | 427/409 |
| 4,755,418 | 7/1988 | DebRoy et al. | 427/409 |
| 4,756,975 | 7/1988 | Fujii et al. | 427/409 |
| 4,761,212 | 8/1988 | Watanabe et al. | 427/409 |
| 4,780,340 | 10/1988 | Takahashi et al. | 427/412.1 |
| 4,789,568 | 12/1988 | Matoba et al. | 427/412.3 |
| 4,820,555 | 4/1989 | Kuwajima et al. | 427/410 |
| 4,846,946 | 7/1989 | Mauer et al. | 427/407.1 |
| 4,857,580 | 8/1989 | Patzschke et al. | 524/507 |
| 4,888,244 | 12/1989 | Masubuchi et al. | 427/407.1 |
| 4,933,214 | 6/1990 | Sugiura et al. | 427/409 |
| 5,116,903 | 5/1992 | Gebregiorgis | 524/589 |
| 5,242,716 | 9/1993 | Iwase et al. | 427/412.1 |
| 5,283,290 | 2/1994 | Jung et al. | 427/386 |
| 5,326,596 | 7/1994 | Kasari et al. | 427/410 |
| 5,330,627 | 7/1994 | Grütter et al. | 427/409 |
| 5,385,656 | 1/1995 | Doebler et al. | 427/409 |

FOREIGN PATENT DOCUMENTS

| | | |
|---|---|---|
| 0126498 | 11/1984 | European Pat. Off. . |
| 3630667 | 3/1987 | Germany . |

*Primary Examiner*—Diana Dudash
*Attorney, Agent, or Firm*—Keck, Mahin & Cate

[57] ABSTRACT

Process for producing a multi-layer lacquer coating of a substrate, in particular of automobiles or their parts, in which for the layer of primer surfacer (filler) a coating agent is used which is based on one or several cationic binding agents. Low stoving temperatures and corrosion protection are achieved.

9 Claims, No Drawings

PROCESS OF PRODUCING MULTILAYER COATINGS WITH CATIONIC LAYERS OF PRIMER SURFACE

This is a continuation application of Ser. No. 08/300,578, filed on Sep. 2, 1994, now abandoned, which is a continuation of application Ser. No. 08/147,100 filed on Nov. 4, 1993, now abandoned, which is a continuation of application Ser. No. 07/959,897 filed on Oct. 13, 1992, now abandoned, the text of which is hereby incorporated by reference.

FIELD OF THE INVENTION

The invention relates to a process for producing a multilayer lacquer coating by using cationic binding agents to produce the cationic coating agent to be used as primer surfacer.

BACKGROUND OF THE INVENTION

In order to satisfy various consumer requirements, automobile lacquering nowadays takes the form of a multi-layer lacquer coating. In this connection the most diverse lacquer films serve various purposes, for example, to achieve protection against the impact of stones, to achieve corrosion protection, or to obtain a good, optically appealing surface. It is known that the primer for achieving corrosion protection can be produced from coating agents on an anionic or cationic basis.

The layers of primer surfacer which are necessary to achieve a sufficient degree of protection against the impact of stones are nowadays based either on a solvent-containing formulation or an aqueous formulation. Up to the present time the only known systems formulated on an anionic basis have been aqueous systems. These coating agents have the disadvantage that in those places where damage has occurred to the layer of anti-corrosion primer only a poor degree of protection against corrosion is afforded. Furthermore it has been shown that the stoving temperatures of the layer of primer surfacer are relatively high. Owing to practical considerations, eg. energy costs or the dimensional stability of plastic substrates, it is necessary, however, to keep the stoving temperatures of the lacquer layers as low as possible.

Binding agents based on a cationic process which are used for corrosion-protection primers are already described in the patent literature. These are deposited by electrophoretic lacquering, ie. an aqueous solution of the binding agents together with conventional additional materials is produced and this is deposited by applying an electric current to the metallic workpiece used as cathode. Then the coated substrate is stoved at temperatures between 150° and 200° C., ie., chemical crosslinking of the coating takes place. Examples of such coating agents are described in DE-OS 36 34 483, DE-OS 36 14 551, DE-OS 36 14 435, EP-A 54 193 and EP-A 193 103. Use is made of binding agents for lacquers which are capable of being deposited at the cathode (KTL) based on amino acrylate resins, amino epoxide resins or amino urethane resins. These are mixed with pigments in a pigment/binding-agent ratio of up to 0.5:1 and dispersed, and with the addition of conventional lacquer additives the coating agent is produced. The solids content of the coating agents generally amounts to 12–22% by weight. Following precipitation these coating agents are stoved at temperatures exceeding 150° C.

These coating agents have the disadvantage that they only contain a small proportion of solids and are therefore not suitable for application by spray. So it is first necessary, by means of stoving, to bring about evaporation of the water still present in the coating agent. In addition, high temperatures are required for crosslinking the coating agent, so that the choice of useable substrates is limited.

Coating agents for offering protection against the impact of stones are equally well-known. These so-called fillers are, for example, known from DE-OS 40 00 748, EP-A 249 727 or DE-OS 38 13 866. Use is made of coating agents based on anionically stabilised coating agents which are processed with conventional pigments and additives to produce the coating agent. Polyurethane resins and reaction products of polyesters and epoxide resins are described as the basis for binding agents. By way of crosslinking agents melamine resins and blocked isocyanates are described. These coating agents have the disadvantage that they require relatively high stoving temperatures of about 150° C. Similarly it has been shown that bare metal parts which have no protective layer of anti-corrosion primer have inadequate protection against corrosion. Such imperfections can arise, for example, as a result of subsequent necessary processing of the car bodies, eg. grinding.

SUMMARY OF THE INVENTION

The object of the present invention is therefore to make available a coating agent for use as primer surfacer in multi-layer lacquering, in particular for automobiles and their parts, said coating agent having improved characteristics as regards corrosion protection and also enabling stoving to take place at low temperatures.

This task is solved according to the invention by producing layers of primer surfacer consisting of coating agents based on one or several binding agents which at least in part contain cationic groups or groups capable of being converted into cationic groups.

DETAILED DESCRIPTION OF THE PREFERRED EMBODIMENT

The layer of primer surfacer can for example be applied directly to a conventional primer, eg. a cathodically or anodically or otherwise deposited layer of primer. But intermediate layers can also be formed between the primer and the layer of primer surfacer; for example, layers for providing protection against the impact of stones. The layer of primer surfacer with a conventional coloured and/or effect-creating layer of surface lacquer or basecoat is preferably given a lacquer topcoat. But here too one or several intermediate layers may be interposed.

The layers of primer surfacer produced according to the invention can be crosslinked or stoved at low temperatures, eg. at 100° to 150° C.

The coating agents serving as layers of primer surfacer can also contain, in addition to one or several cationically stabilised binding agents, other binding and crosslinking agents. They can also contain conventional pigments and/or filler materials, as well as conventional lacquering additives, such as catalysts. By way of solvent they can contain water and/or organic solvents. They preferably contain water as principal solvent, with small proportions of one or several organic solvents. Water is preferably used in completely softened form.

The binding agents are preferably based on polyacrylate, polyester, polyurethane or epoxide resins or mixtures thereof. They contain groups which are at least partly cationic or substituents capable of being converted into cationic groups. These cationic groups can, eg., contain nitrogen and be quaternised. Groups capable of being converted into cationic groups can, for example, also contain nitrogen and be neutralised with conventional neutralising agents, eg. inorganic acids or organic acids, or be converted into cationic groups. Examples of acids which can be used are phosphoric acid, acetic acid and formic acid. By the number of these groups the solubility characteristics in water can be influenced. The binding agents can be self-crosslinking or crosslinked extraneously, ie. crosslinking agents can also be added. These are chosen from, eg., the group of melamine resins, transesterification crosslinking agents or blocked isocyanates. Binding agents which can be added in proportion also include resins which fulfil special lacquering functions. Examples are rheological resins or pasting resins.

Examples of binding agents which can be used in the coating agents according to the invention are listed below. Use may, for example, be made of the binding agents described in DE Patent Application P 40 11 633 for basecoat lacquers. These are, eg., poly(meth)acrylate resins containing basic groups, which are produced by solution polymerisation or by emulsion polymerisation or copolymerisation and have a hydroxy number from 10 to 400, preferably from 30 to 200 mg KOH per g solid resin. The number average molecular weight ($\overline{M}n$) is of the order of 500 to 100000 and preferably 1000 to 10000 (determined by gel permeation chromatography, calibrated with polystyrene fractions). Their viscosity is preferably between 0.1 and 10 Pa.s, in particular 0.5 to 5 Pa.s, in 50% solution in monoglycol ethers (in particular, butoxyethanol) at 25° C. Their second-order transition temperature (calculated from the second-order transition temperatures of homopolymers) are of the order of −50° to +150° C., and preferably in the range −20° to +75° C. The appropriate average molecular weights or viscosities can also be obtained by mixing resins of relatively high and relatively low molecular weight or viscosity. The amine number is of the order of 20 to 200, preferably from 30 to 150, and in particular 45 to 100 (mg KOH per g of solid resin).

The poly(meth)acrylate resins containing basic groups can be produced according to the state of the art, as described for example in DE-A 15 46 854, DE-A 23 25 177 or DE-A 23 57 152. Useable as ethylenically unsaturated monomers are practically all monomers capable of radical polymerisation. The basic poly(meth)acrylate resin can also contain, instead of or in addition to the amino groups, onium groups such as quaternary ammonium groups, sulfonium or phosphonium groups. Particularly preferred are amino groups which make the resin capable of being diluted with water after being neutralised with organic acids. A mixed polymer of this type containing amino groups and hydroxyl groups is obtained by polymerisation in solution or by emulsion polymerisation. Solution polymerisation is preferred.

The poly(meth)acrylate resin is produced from (meth-)acrylate monomers, optionally together with additional monomers capable of radical polymerisation. The monomers capable of radical polymerisation, ie. the (meth)acrylate monomers and/or additional monomers capable of radical polymerisation are monomers capable of radical polymerisation which contain amino groups or both amino groups and hydroxyl groups. They can be used in a mixture with other monomers capable of radical polymerisation.

Monomers which can be used are those of the general formula:

$$R—CH{=}CR'—X—B$$

where $R{=}R'$ or $—X—C_nH_{2n+1}$ $R'{=}—H$ or $—C_nH_{2n+1}$ $R''{=}—R'$, $—C_nH_{2n}OH$ and/or $—C_nH_{2n}NR_2$ $B{=}A—N(R'')_2$ or $C_1$–$C_6$-alkyl with 1–3 OH groups $X{=}—COO—$, $—CONH—$, $—CH_2O$ or $—O—$ $A{=}—C_nH_{2n}—$ or $$—C_nH_{2n}—\underset{\underset{OH}{|}}{CH}—CH_2—$$

and n=1 to 8, preferably 1 to 3.

Examples of unsaturated monomers containing N-groups are N-dialkyl or N-monoalkyl aminoalkyl (meth)acrylates or the corresponding N-alkanol compounds or the corresponding (meth)acrylic amide derivatives.

Monomers containing hydroxyl groups and capable of radical polymerisation are, eg., those which contain, in addition to a polymerisable ethylenically unsaturated group, at least one hydroxyl group attached to a $C_2$ to $C_{20}$ linear, branched or cyclic carbon structure.

Copolymerisation is effected by known means, preferably by solution polymerisation with the addition of radical initiators as well as, optionally, regulators at temperatures of, eg., 50° to 160° C. It is effected in a liquid in which monomers and polymers dissolve jointly. The quantity of monomers or polymers after polymerisation is complete amounts to about 50 to 90% by weight. Solution polymerisation is preferred in organic solvents which are capable of being diluted with water. By way of initiators which are soluble in organic solvents, 0.1 to 5% by weight, and preferably 0.5 to 3% by weight, of peroxides and/or azo-compounds are added, relative to the quantity of monomers used. By way of initiators peroxides, peresters or azo-compounds which decay thermally into radicals can be used.

By the use of regulators the molecular weight can be reduced in known manner. Mercaptans, halogen-containing compounds and other radical-converting substances are preferably used. Particularly preferred are n- or tertiary-dodecylmercaptan, tetrakismercaptoacetyl pentaerythritol, tertiary-butyl-o-thiocresol, butene-1-ol or dimeric α-methylstyrene.

Production of amino poly(meth)acrylate resins can also be effected by reaction analogous to polymerisation. For example, a copolymer containing acrylic amide groups can be caused to react with formaldehyde and a secondary amine and/or amino alcohol. A particularly preferred process is described in DE-A 34 36 346. In this process mono-ethylenically unsaturated monomers containing epoxide groups are firstly polymerised into the copolymer. Then reaction is brought about with excess ammonia, primary and/or secondary monoamines and/or monoamino alcohols, and subsequently the amine excess is distilled off. A similar reaction can, for example, be carried out, preferably in equivalent amounts, with ketimines or polyamines containing a secondary amino group and one or several blocked or tertiary amino groups, such as the monoketimine formed from methyl isobutyl ketone and methyl aminopropyl amine or the diketimine formed from methyl isobutyl ketone and diethylenetriamine. The proportion of unsaturated monomers containing epoxide groups in copolymer generally amounts to 8 to 50% by weight. The lower limit preferably lies around 12% by weight, the upper limit around 35% by weight. Polymerisation must be fully completed before the reaction with amines takes place, since otherwise reversible side reactions with the secondary amines can occur at the activated double bonds of the monomers.

Particularly suitable amines for the reaction with the epoxide groups are primary or secondary amines of the formula:

$$R—NH—R'$$

where $$R=—H \text{ or } —R'$$

$$R'=—C_nH_{2n+1}, —C_nH_{2n}OH \text{ and/or } —C_nH_{2n}—N=C(\text{alkyl})_2$$

and n=1 to 8, preferably 1 to 2, and alkyl has 1 to 8 C atoms and, in the case of R=R', the residues can be the same or different.

The following amines can, for example, be used for the reaction: $C_1$ to $C_6$ dialkyl amines with the same or different alkyl groups in the molecule, monocycloaliphatic amines, monoalkanol amines, dialkanol amines as well as primary amines or amino alcohols. Particularly preferred are secondary amines such as dimethyl amine, diethyl amine, methyl ethyl amine or N-methyl amino ethanol, since these enable lacquers with good solubility and a high pH-value to be obtained after neutralisation. The above-stated primary amines are mostly used in a mixture with secondary amines, since otherwise products are formed which are too highly viscous. The number of the epoxide groups determines the number of the amino groups entering into the reaction therewith and also the solubility of the product. There should be at least one epoxide group present per molecule. It is often advantageous to combine a high hydroxy number with a low amine number and vice versa. The development target is generally a product with good solubility, a low degree of neutralisation and as a high a pH-value as possible.

In another preferred process the incorporation of amino groups is successfully achieved by causing a poly-(meth)acrylate resin containing hydroxyl groups to react with amino compounds containing isocyanate groups. The amino compounds are, for example, produced by the reaction of 1 mol diisocyanate with 1 mol dialkyl amino alkanol.

Another preferred group of basic binding agents are hydroxyl-functional polyesters, whereby the amino groups are either directly condensed into the polyester as amino alcohols or, in a milder process, are incorporated into the polymer chain by means of polyaddition or attached to the polymer chain. By this process, for example, a urethanised polyester containing OH groups is constructed by causing a polyester to react with dialkyl amino dialcohols and diisocyanates. Alcohols, amino alcohols or isocyanates of higher functionality can also be used in part. If a reduced amount of isocyanate is used, the resin must be capable of being directly dispersed in water after being neutralised with acids.

If, on the other hand, isocyanate is present in excess, the NCO prepolymer formed can be dispersed in water and can, by chain extension with a polyamine, be converted into a polyurethane(carbamide) dispersion. These binding agents contain no groups which are suitable for crosslinking. They can therefore only be used in part.

In the production of polyester urethane resins the equivalent ratio of the diisocyanate used is chosen to match the polyols and diols used so as to ensure that the finished polyester urethane resin preferably has a number average molecular weight ($\overline{M}n$) between 3000 and 200000 and in particular less than 50000. The viscosity of the polyester urethane resin lies preferably in the region of 1 to 30 Pa.s, in particular above 5 and below 15 Pa.s, determined at 60% in butoxyethanol at 25° C.

Production of polyurethane(carbamide) dispersions containing basic groups is effected in known manner, eg. by chain extension of a cationic prepolymer or a prepolymer capable of becoming cationic and having a terminal isocyanate group with water, polyols, polyamines and/or hydrazine compounds, whereby chain extension before or after neutralisation of the tertiary amino groups is effected with these in water. The amine number is controlled by the quantity of compounds containing cation groups in the prepolymer containing isocyanate groups used in the production process. The particle size is dependent on the molecular weight of the polyol used, eg. the OH polyester (polyester polyol), the amine number and the structural sequence. The number average molecular weight preferably lies between 3000 and 500000, in particular above 5000 and below 50000. Polyurethane dispersions containing carbamide groups are preferably produced containing at least two, and preferably four, urethane groups and at least one tertiary amino group, especially a dialkyl amine group, in the NCO prepolymer.

Production of the cationic prepolymers containing isocyanate groups which are suitable for use in polyurethane(carbamide) dispersions is effected, eg., by simultaneously causing a polymer mixture to react with diisocyanates in a preferred ratio of NCO groups to OH groups ranging from more than 1.00 to 1.4. The polyol mixture preferably consists of one or several saturated OH polyesters, optionally with the addition of one or several diols of low molecular weight and a compound with two H groups which are capable of reacting with isocyanate groups and additionally contain a group capable of forming cations.

Production of the polyester polyol can be effected in various ways, for example in a melt or by azeotropic condensation at temperatures from, eg., 160° to 260° C., preferably of dicarboxylic acids and dialcohols which optionally can be slightly modified by small quantities of trialcohols. The reaction is continued, optionally with the addition of catalysts such as stannous octoate or dibutyl stannous oxide, until such time as practically all carboxylic groups (acid number $\leqq 1$) have been caused to react. The necessary OH number of 35 to 200, preferably over 50 and under 150, or molecular weight from 500 to 5000, preferably over 800 and under 3000, is determined by the excess of alcohol used.

The dicarboxylic acids preferably used have a linear or branched aliphatic, alicyclic or aromatic structure. For polyesters that are particularly resistant to hydrolysis, diols are used which have sterically blocked primary OH groups or secondary hydroxyl groups. Examples are 1,4-cyclohexanediol, 2-ethyl-1,3-hexanediol, cyclohexane dimethanol and the hydrated biphenols A or F. The dialcohols can contain small amounts of higher polyols such as glycerine or trimethylolpropane in order to establish branching. The amount should however be sufficiently small as to ensure that no crosslinked products are formed. A linear aliphatic structure is preferred, which optionally can contain a proportion of an aromatic dicarboxylic acid and preferably contains an OH group at the end of the molecule.

By way of polyester polyols according to the invention polyester diols can also be used which are obtained by condensation of hydroxycarboxylic acids.

In order to influence the molecular distribution and the number of urethane groups incorporated, 2 to 30% by weight of the polyester of relatively high molecular weight can be exchanged for glycols or dialkanols of low molecular weight. Preferably used for this purpose are the dialkanols used for the polyester, with a molecular weight ranging from 62 to around 350. The dialkanols used in the process do not have to be identical with those used in the polyester.

In order to be able to dissolve the polyester urethane resin in water, some of the diols of low molecular weight are replaced by diols which still contain at least one onium-salt group or one amino group capable of being neutralised by acid. Suitable basic groups capable of forming cations are primary, secondary or tertiary amino groups and/or onium groups such as quaternary amino groups, quaternary phosphonium groups and/or tertiary sulfonium groups. Dialkyl amino groups are preferably used. The basic groups should be so unreactive that the isocyanate groups of the diisocyanate preferably react with the hydroxyl groups of the molecule.

Equally preferred are aliphatic diols such as N-alkyl dialkanol amines with, as alkyl or alkane residue, aliphatic or cycloaliphatic residues with 1 to 10 carbon atoms, eg. methyl diethanol amine.

The quantity of salt groups present as a result of neutralisation generally amounts to at least 0.4% by weight up to about 6% by weight, relative to the amount of solid material.

The cationic groups of the NCO prepolymer used for the production of the polyurethane dispersions are neutralised at least partly with an acid. The increase in the dispersability in water thereby achieved suffices to disperse stably the neutralised polyurethane which contains urea groups. Suitable acids are organic monocarboxylic acids. Following neutralisation the NCO prepolymer is diluted with water and a finely-particled dispersion results, with an average particle diameter of 25 to 500 nm. Shortly afterwards the isocyanate groups still present can be caused to react with di- and/or polyamines with primary and/or secondary amino groups, or hydrazine and its derivatives or dihydrazides as chain extenders. This reaction leads to further linking and an increase in the molecular weight. The quantity of the chain extender is determined by its functionality or by the NCO content of the prepolymer. The ratio of reactive amino group in the chain extender to the NCO groups in the prepolymer should as a rule be less than 1:1 and should preferably lie in the range 1:1 to 0.75:1.

Examples are polyamines with linear or branched aliphatic, cycloaliphatic and/or (alkyl)aromatic structure and at least two primary amino groups. Examples of diamines are ethylene diamine, hexamethylene diamine-1,6, isophorone diamine and amino ethylethanol amine. Preferred diamines are ethylene diamine, propylene diamine and 1-amino-3-aminomethyl-3.3.5-trimethylcyclohexane or mixtures thereof. Chain extension can be at least partly effected with a polyamine which has at least three amino groups with hydrogen capable of reaction, such as diethylenetriamine. By way of chain extender use can also be made of diamines, the primary amino groups of which are protected as ketimine and which after emulsifying in water become reactive as a result of the ketone splitting off hydrolytically.

In another preferred method polyaddition is implemented subject to considerable dilution with dry solvents that do not react with isocyanate. Chain extension is effected in this case with polyols, polyamines or amino alcohols.

Non-aqueous ketones of low boiling-point, such as acetone, methyl ethyl ketone or methyl isopropyl ketone, can serve as solvents, but so can esters such as acetoacetic ester. After neutralisation with acids and dilution with water the volatile solvent, optionally in a vacuum, must be distilled off subject to heating.

Typical diisocyanates used for reacting with the polyol/diol mixture are, for example, those based on linear or branched aliphatic, cycloaliphatic and/or aromatic hydrocarbons with an NCO content of 20 to 50%. They contain as functional groups two isocyanate groups which are arranged asymmetrically or symmetrically within the molecule. They can be aliphatic, alicyclic, arylaliphatic or aromatic.

Mixtures of various isocyanates can also be used.

Synthesis into a sequenced structure is effected by joint reaction of the reactaunts in a mixture, or in stages.

Polyisocyanates with more than two isocyanate groups are defunctionalised by causing them to react with monofunctional compounds that react with isocyanate. Preferred in this case are compounds which retain one basic amino group after the reaction, in order in this way to establish a salt-forming group. By reaction with dialkyl amino alcohols or dialkyl amino alkyl amines, basic 'diisocyanates' are produced under mild reaction conditions whereby the alkyl groups have a linear or branched, aliphatic or cycloaliphatic structure with C chains of 1 to 10 carbon atoms.

These binding agents essentially contain no groups which are suitable for crosslinking. They can therefore only be used as a proportion of the coating agent.

In DE-OS 33 33 834 examples of cationically stabilised polyurethane resins are described which have groups capable of crosslinking, eg. OH groups.

Examples are basic polyurethane resins with an amine number from 20 to 150 and a hydroxy number from 50 to 400. In like manner to the polyesters they can be produced at low temperatures by reaction of a) bivalent and/or aliphatic and/or cycloaliphatic saturated polyalcohols of higher valency with b) aliphatic and/or cycloaliphatic and/or aromatic bivalent polyisocyanates and/or polyisocyanates of higher valency with c) optionally linear and/or branched, aliphatic and/or cycloaliphatic $C_3$ to $C_{20}$ monoalcohols.

Preferred are polyester urethane resins with an amine number from 35 to 100 and an OH number from 100 to 300. They are preferably produced by reaction of diisocyanates with polyalcohols in excess at temperatures from 20° to 150° C. Used by way of polyalcohol is a basic polyester of relatively high molecular weight and containing hydroxyl groups, or a mixture of an OH polyester free from carboxylic groups and a dialcohol of low molecular weight which additionally contains an amine group capable of forming cation groups. Preferably used for this purpose is, for example, N-methyl diethanol amine. The molecular weight should be between 500 and 200000.

Binding agents based on cationic polyepoxide resins are already described in the literature. In DE-OS 38 12 251, EP-A 0 234 395, DE-OS 27 01 002, EP-A 0 287 091, EP-A 0 082 291 or EP-A 0 227 975, self-crosslinking or extraneously crosslinking binding agents based on reaction products of polyepoxides with compounds containing amino groups are described. These involve the use, for example, of reaction products of polyepoxides with aromatic or aliphatic diols and/or diamines. These reaction products can be further modified, eg. by causing them to react with partially blocked isocyanates, with monofunctional epoxide compounds, with compounds containing carboxylic groups or with OH-functional components. While aromatic components, eg. aromatic diols such as bisphenol A, improve anti-corrosion characteristics, aliphatic components, eg. aliphatic glycol ethers such as polyethylene glycols, bring about increased flexibility of the binding agents.

Solubility can be influenced by the number of amino groups. The amine number should be between 20 and 200 mg KOH/g of solid resin, preferably between 30 and 150. Primary, secondary and/or tertiary amino groups can be present. The hydroxyl number influences the crosslinking density. It should preferably lie between 20 and 400. At the same time each molecule of the binding agent should have on average at least two reactive groups, eg. OH or NH groups. The reactivity of the binding agents is influenced by the type of group, ie. primary amino or hydroxyl groups are more reactive than secondary groups, whereby NH groups are more reactive than OH groups. The binding agents should preferably contain reactive amino groups. The binding agents according to the invention can, when caused to react, comprise additional groups capable of crosslinking, such as blocked isocyanate groups or groups capable of transesterification. In this case self-crosslinking binding agents are used. It is possible, however, additionally to admix crosslinking agents to the binding agents. The number average molecular weight ($\overline{M}n$) of the binding agents lies between 500 and 20000, in particular between 1000 and 10000.

The basic base-resin binding agents described are self-crosslinking or extraneously crosslinking and can be used either separately or in a mixture.

To achieve a crosslinked layer of primer surfacer, crosslinking agents can also be admixed. The quantity can be chosen in accordance with the respective functionality. It amounts to, eg., 0–40% by weight relative to the mixture of binding agents and crosslinking agents.

By way of crosslinking agents aminoplast resins such as melamine resins can, for example, be used. They can, for example, also be modified, eg. by etherification with unsaturated alcohols. These substances are conventional commercial products.

Examples of transesterification crosslinking agents are non-acidic polyesters with lateral or terminal β-hydroxyalkyl ester groups. These are esters of aromatic polycarboxylic acids, such as isophthalic acid, terephthalic acid, trimellitic acid or mixtures thereof. These are, eg., condensed with ethylene glycol, neopentyl glycol, trimethylolpropane and/or pentaerythritol. The carboxylic groups are then caused to react with optionally substituted 1,2-glycols while forming β-hydroxyalkyl compounds. The 1,2-glycols can be substituted by saturated or unsaturated alkyl, ether, ester or amide groups. A hydroxyalkyl ester formation is also possible, in which the carboxylic groups are caused to react with substituted glycidyl compounds such as glycidyl ethers and glycidyl esters.

The product preferably contains more than three β-hydroxyalkyl ester groups per molecule and has a number average molecular weight from 1000 to 10000, preferably between 1500 and 5000. The useable non-acidic polyesters with lateral or terminal β-hydroxyalkyl ester groups can be produced in the manner described, for example, in EP-A 0 012 463. The compounds described therein also represent examples of useable polyesters.

By way of crosslinking agents the di- and polyisocyanates described earlier can also, for example, be used, whereby the reactive isocyanate groups are blocked by protective groups. Preferably used for this purpose are trivalent polyisocyanates and polyisocyanates of higher valency, eg. trivalent to pentavalent, in particular trivalent aromatic and/or aliphatic blocked polyisocyanates with a number average molecular weight ($\overline{M}n$) from 500 to 1500. Particularly suitable polyisocyanates are the so-called 'lacquer polyisocyanates' which are produced from the aliphatic diisocyanates described above. Another group of polyfunctional isocyanates are oxadiazine trion alkyl diisocyanates, which can be added onto trimethylolpropane. Polyisocyanates of higher functionality can also be produced by reacting 2 mol of triisocyanates with H-active difunctional compounds such as dialcohols, diamines or amino alcohols such as ethanol amines.

The free isocyanate groups are blocked jointly or individually so that they are protected at room temperature against the action of water or the active hydrogen atoms of the base resin (hydroxyl or amine-hydrogen groups). Suitable as blocking agent are monofunctional compounds containing acidic hydrogen with only a single amine, amide, imide, lactam, thio, ketoxime or hydroxyl group. The products resulting in this way have been variously described in the literature.

Possible as pigments or filling materials are, for example, organic colouring pigments, iron oxides, lead oxides, titanium dioxide, barium sulphate, zinc oxide, mica, kaolin, quartz powder or various types of silicic acid. The particle diameter of the pigments should be <15 μm. Similarly it is possible to use at least partially crosslinked organic filling materials, so long as these do not swell up in the solvent and also exhibit the necessary fineness of grain.

By way of lacquering additives, rheology-influencing agents, anti-settling agents, levelling agents, defoaming agents, dispersing agents and catalysts should, for example, be mentioned. These serve to enable special adjustment of lacquering or application characteristics.

Conventional lacquering solvents are suitable as solvent. These can stem from the production of the binding agents. It is advantageous if the solvents can at least partly be mixed with water. Examples of such solvents are glycol ethers, eg. butyl glycol, ethoxy propanol, diethyleneglycol dimethyl ether; alcohols, eg. isopropanol, n-butanol; glycols, eg. ethylene glycol; N-methyl pyrrolidone and ketones. By the choice of solvent the levelling and the viscosity of the coating agent can be influenced. The boiling-point of the solvents used can influence the evaporation characteristics.

The weight ratio of pigment to binding agent lies for example between 0.75:1 and 2.5:1, preferably between 1.0:1 and 1.8:1. The solids content of the coating agent lies between 25 and 60% by weight, preferably between 30 and 50% by weight. The amount of solvent is <15% by weight, preferably <10% by weight, in each case relative to the aqueous coating agent.

The processes for producing aqueous coating agents from the binding agents are well-known. For example, the process may start from the aqueous binding-agent dispersion, to which, subject to vigorous stirring, pigments and filling materials, as well as additives and auxiliary agents are added. After thorough homogenisation the mixture is optionally ground to give the necessary fineness of grain. Suitable grinding aggregates are already described in the literature. After grinding of the coating agent, other, optionally different, binding agents can optionally be admixed. Then a suitable viscosity can be set by using water or organic-solvent components. As an additional procedure it is, eg., possible to disperse the pigments and auxiliary materials in the form of a solvent-containing binding agent, optionally to grind it, and, after neutralisation, to convert the mixture to the aqueous phase. Then the viscosity can be adjusted with water. The finished coating agent is capable of being stored for a long period and exhibits no substantial changes in viscosity or tendency towards sedimentation. With a view to application, a suitable low viscosity can optionally be adjusted with water, eg. for spraying.

The coating agent is applied by rolling, milling or spraying, preferably by means of a spray-application process. Examples are compressed-air sprays, airless sprays, hot sprays or electrostatic spraying. Particularly suitable by way of substrate are automobile bodies or parts thereof; they can be metal or plastic. Metal parts are usually coated with an electrophoretically deposited anti-corrosion primer or another layer of conventional primer or intermediate layer. This is normally stoved at temperatures >150° C. Examples of such primers are described in DE-A 36 15 810, DE-A 36 28 121, DE-A 38 23 731, DE-A 39 20 214 and DE-A 39 40 782, as well as EP-A 0 082 291, EP-A 0 209 857 and EP-A 234 395. Plastic substrates are provided with adhesion-promoting coatings or primers based on two-component coating agents or physically drying coating agents. These coatings can optionally be treated by mechanical working, eg. grinding.

The coating agent according to the invention is applied to the precoated substrates. After a short flash-off period, optionally at elevated temperatures, the workpiece is stoved with the film of coating at temperatures between 100° and 150° C. The film thickness measures 15–120 μm and is preferably between 25 and 80 μm. After crosslinking, the surface is optionally given an aftertreatment, eg. by grinding, in order to achieve a smooth surface without imperfections. Then to this layer of primer surfacer the colour-and/or effect-creating lacquer film, eg. a uni-surface lacquer or a metallic basecoat lacquer, can be applied. With the use of aqueous anionic basecoat layers particularly good adhesion to the layer of primer surfacer can be achieved.

The process according to the invention is particularly well suited for producing a multi-layer lacquer coating. Also in the event of mechanical damage this affords improved corrosion protection on metal parts. With the procedure according to the invention, optically smooth, homogeneous multi-layer coatings are obtained which are resistant to the impact of stones. These coatings satisfy greater demands in series production lacquering in the automobile industry.

On the basis of the following Examples the process according to the invention is described in more detail:

Example 1

A solution of 2878 g of an epoxide resin based on bisphenol A with an epoxide equivalent weight of 194 and 1497 g of nonylphenol was created in 1093 g of xylene and heated to 100° C. To this solution 2 g of a 50% aqueous solution of tetrabutyl ammonium chloride was added and after heating to 140° C. this temperature was maintained until such time as the epoxide equivalent weight of the solution amounted to 740. After cooling to 50° C. a solution of 1225 g of ethylene diamine in 1225 g of xylene was added. After four hours at 105° C. the excess xylene/diamine mixture was distilled off in a vacuum. Fresh xylene was added repeatedly and again distilled off until the amine number in the distillate was less than 0.5. A product with an amine number of 160 was obtained. This was diluted with methyl isobutyl ketone to yield a solids content of 70%.

Example 2

To a solution consisting of 3000 g of methyl isobutyl ketone and 1547 g of 1,6-hexane diol were added 5453 g of trimethylhexamethylene diisocyanate and a reaction was brought about at 80° C. until an NCO number of 11% was obtained.

Example 3

5100 g of the resinous solution from Example 1 was heated to 130° C. with removal of water by rotation and after subsequent cooling to 40° C. mixed with 2120 g of the solution from Example 2 and caused to react at 80° C. until such time as free isocyanate could no longer be detected by infra-red spectroscope. Then 300 g of water was added and in a vacuum at 80° C. the methyl isobutyl ketone was distilled off. Then the solution was diluted with 1800 g of ethoxypropanol and distilled in a vacuum until such time as a solids content of 73% was obtained. A product with an amine number of 50 was obtained.

Example 4

2460 g of butanone oxime was added to 5890 g of a 90% solution of trimerised hexane diisocyanate in butyl acetate and caused to react at 80° C. until such time as free isocyanate could no longer be detected by infra-red spectroscope. Then 1650 g of butyl glycol was added and the butyl acetate was distilled off in a vacuum at 80° C.

Example 5

100 parts of the binding agent from Example 3 were added to 4.42 parts of a 50% aqueous solution of formic acid and after addition of 5 parts of butyl diglycol, 1.42 parts of a commercial levelling agent and 0.60 parts of a commercial non-ionic tenside, and intensive mixing, diluted with 196 parts of de-ionised water. Then 31.3 parts of the crosslinking agent from Example 4 were added to the mixture which was stirred vigorously. The pH-value amounted to 5.4. In order to test its reactivity, the unpigmented lacquer was applied with a dry-layer thickness of 26 μm to a temperature-gradient metal sheet. The following results were obtained:

| | 20 min object temperature (°C.) | | | | | | | |
|---|---|---|---|---|---|---|---|---|
| | 120 | 125 | 130 | 140 | 150 | 160 | 170 | 178 |
| Erichsen cupping (DIN ISO 1520) | 0.9 | 8.3 | 7.8 | 7.7 | 7.7 | 7.7 | 7.7 | 8.2 |
| MEK RUB test* (100 strokes up and down) | 3 | 2 | 1 | 1 | 1 | 1 | 1 | 1 |

*test of crosslinking with a swab soaked in methyl ethyl ketone; 1 = unchanged, 2 = slight matting, 3 = destroyed.

Example 6

Into a mixture consisting of 9.34 parts of the binding agent from Example 3, 0.87 parts of a 50% aqueous solution of formic acid, 18.67 parts of de-ionised water, 0.42 parts of butyl diglycol and 0.84 parts of a commercial levelling agent were stirred 0.04 parts of carbon black, 0.17 parts of aerosil, 0.83 parts of benzoin, 3.24 parts of kaolin, 9.34 parts of barium sulphate and 7.73 parts of titanium dioxide, and intensive mixing was effected under the dissolver. Then an additional 3.63 parts of the binding agent from Example 3 and 8.48 parts of de-ionised water were added under the dissolver. This mixture was subsequently intensively ground in a pearl mill and made up into a lacquer with 5.92 parts of the binding agent from Example 3, 0.21 parts of a commercial non-ionic tenside, 5.93 parts of the crosslinking agent from Example 4, 24.17 parts of de-ionised water and 0.17 parts of a 50% aqueous solution of formic acid. This grey cationic hydrofiller was sprayed with a dry-layer thickness of 30 to 35 μm onto a metal test sheet coated with KTL (18 μm) and stoved on the gradient-type furnace for 20 min in the region of 130° to 190° C. After stoving, the metal test sheet was partially unstuck and then coated by spray application with a commercial single-layer surface lacquer with a dry-layer thickness of 40 μm and stoved for 30 min at 130° C. A multi-layer lacquer coating was obtained possessing good mechanical characteristics, good resistance to the impact of stones and good corrosion protection. In addition, the crosslinking of the stoved layer of primer surfacer within the pre-selected temperature gradient at the previously unstuck part was tested. The results can be seen from the following table:

| | 20 min object temperature (°C.) | | | |
|---|---|---|---|---|
| | 130 | 150 | 165 | 190 |
| MEK RUB test (100 strokes up and down) | 2 | 1 | 1 | 1 |

The corrosion protection of the substrates coated according to the invention is also good if the KTL primer exhibits defects right through to the metal.

What is claimed is:

1. Process for producing a multi-layered lacquer coating of a substrate, comprising:

applying a layer of primer, applying a layer of primer surfacer above the layer of primer, wherein the layer of primer surfacer comprises a coating agent which contains one or several cationic crosslinking binding agents which are polyacrylate, polyester, polyurethane or epoxide resins or mixtures thereof and which at least in part contain cationic groups and optionally groups which are capable of being converted into cationic groups, stoving the layer of primer surfacer at a temperature between 100° and 150° C., thereby crosslinking the primer surfacer, and applying a layer of surface lacquer above the layer of cross-linked primer surfacer.

2. Process according to claim 1, wherein said coating agent further contains pigments.

3. Process according to claim 1, wherein the coating agent further comprises water as a solvent.

4. Process according to claim 1, wherein the crosslinking binding agents have an OH number from 10 to 400, an amine number from 20–200 and a number average molecular weight from 500 to 200,000.

5. Process according to claim 1, wherein said groups capable of being converted into cationic groups comprise at least one member selected from the group consisting of primary amino groups and secondary amino groups.

6. Process according to claim 1, wherein the coating agent additionally comprises at least one cross-linking agent selected from the group consisting of aminoplast resins, transesterification crosslinking agents and blocked isocyanates.

7. Process according to claim 1, wherein the coating agent further comprises at least one agent containing no groups capable of crosslinking.

8. Multi-layer lacquer coating on a substrate obtained according to a process of one of claims 1 to 7.

9. A process according to claim 3, wherein the coating agent further comprises at least one organic solvent.

* * * * *